United States Patent [19]

Williams

[11] 4,022,387

[45] May 10, 1977

[54] ROLLER GRINDING MILL APPARATUS

[75] Inventor: Robert M. Williams, Ladue, Mo.

[73] Assignee: Williams Patent Crusher and Pulverizer Company, St. Louis, Mo.

[22] Filed: Mar. 12, 1976

[21] Appl. No.: 666,407

[52] U.S. Cl. ..... 241/130

[51] Int. Cl.[2] ..... B02C 15/02

[58] Field of Search ..... 241/129, 130, 131, 133

[56] References Cited

UNITED STATES PATENTS

| | | | |
|---|---|---|---|
| 65,790 | 6/1867 | Belleville | 227/156 X |
| 844,085 | 2/1907 | Barthelmess | 241/130 |
| 2,200,825 | 5/1940 | Hund | 241/129 |
| 2,303,319 | 12/1942 | Beardsley et al. | 241/129 |
| 2,601,954 | 7/1952 | Crites | 241/133 |
| 3,337,142 | 8/1967 | Williams | 241/130 |

*Primary Examiner*—Granville Y. Custer, Jr.
*Attorney, Agent, or Firm*—Gravely, Lieder & Woodruff

[57] ABSTRACT

Roller grinding mill apparatus comprising a stationary bull ring which cooperates with a plurality of centrifugally operated grinding rollers and means for setting a predetermined gap space between the grinding rollers and the grinding face of the bull ring so that the grinding rollers will be unrestricted so as to move in radial directions in response to centrifugal force, but will not normally be permitted to contact the grinding face of the bull ring.

3 Claims, 3 Drawing Figures

ROLLER GRINDING MILL APPARATUS

BACKGROUND OF THE INVENTION

In the roller mill art it has been general practice to construct the mills where the grinding rollers do not move in a circular path but are moved radially toward and away from a rotating bowl having a grinding face presented to the grinding rollers. Another form of roller mill is to present the bull ring in a stationary setting and to rotate the grinding rollers in a circular path relative to the bull ring so that centrifugal force will force the grinding rollers toward the bull ring. The present invention is directed toward the second type of roller mill in which the bull ring is stationary and the means for driving the grinding rollers centrifugally includes means to provide a constant gap between the rollers and the bull ring without in any other way interfering with the free action of the grinding rollers so that the grinding force exerted on the material to be grounded against the stationary bull ring is varied as the square of the speed of rotation of the grinding rollers. In other words, the principle of the present invention is to establish a predetermined gap space between the stationary bull ring and the path traveled by grinding rollers so as to maintain a constant desirable minimum gap space while not offsetting or obstructing the centrifugal force holding the grinding rollers in operative position.

In prior roller grinding mills of the present type it has always been necessary to have sufficient material in the grinding chamber at all times so as to provide a sufficient layer of material to be ground between the grinding rollers and the bull ring, thereby preventing metal to metal contact. There is an important reason why prior mills required such a condition and that is to avoid the resulting vibration and extreme noise that resulted from metal to metal contact, and to avoid the self destructive result.

BRIEF DESCRIPTION OF THE INVENTION

This invention pertains to improvements in roller grinding mill apparatus for comminuting solid materials requiring reduction in size.

The improvements are embodied in a roller mill having a stationary bull ring concentric with a central shaft which operatively supports a plurality of grinding rollers. The rollers are pivoted from a driving head so that centrifugal action forces the rollers to pivot into grinding relation with the bull ring. In an assembly of this character there is arranged means of a semi-rigid nature which is disposed to hold the rollers at predetermined desired spacing from the bull ring to produce a product having the selected reduction in size.

It is a principal object of this invention to construct a roller grinding mill with means to position the grinding rollers at a desired gap or spacing from the bull ring so as to avoid the noise and destructive results that can occur when the supply of material to be ground is cut off or interupted while the mill is operating. Other objects will be set forth in the detailed description.

A previously preferred embodiment of the present invention comprises a stationary bull ring having an inwardly present grinding face, a plurality of grinding rollers, means operably mounting said rollers for rotation about a common axis centered to said grinding face and for pivotal movement in radial direction toward and away from said grinding face, said operable mounting including means to set a predetermined gap spacing between said rollers and said grinding face, whereby said rollers are free to move radially limited only by said gap spacing, and drive means connected to rotate said roller mounting means to generate a centrifugal force urging said rollers toward said grinding face.

BRIEF DESCRIPTION OF THE DRAWINGS

The present embodiment of the roller grinding mill apparatus is shown in the accompanying drawings, wherein.

DETAIL DESCRIPTION OF THE EMBODIMENT

Figure 1:
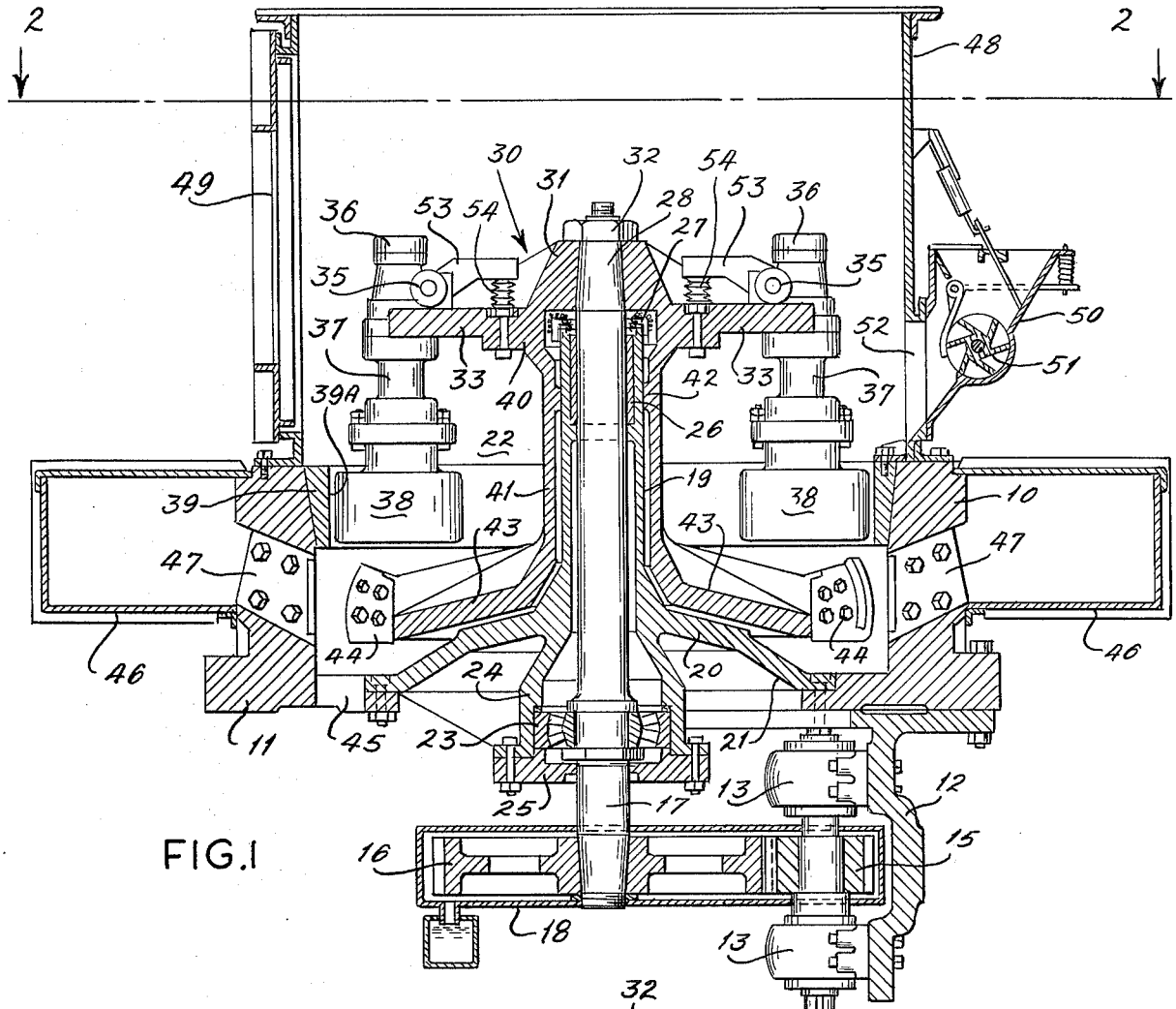
FIG. 1 is a sectional elevational view of the apparatus showing the operative means comprising the present invention and including only those portions which will serve to illustrate the principle of the same.
Figure 2:
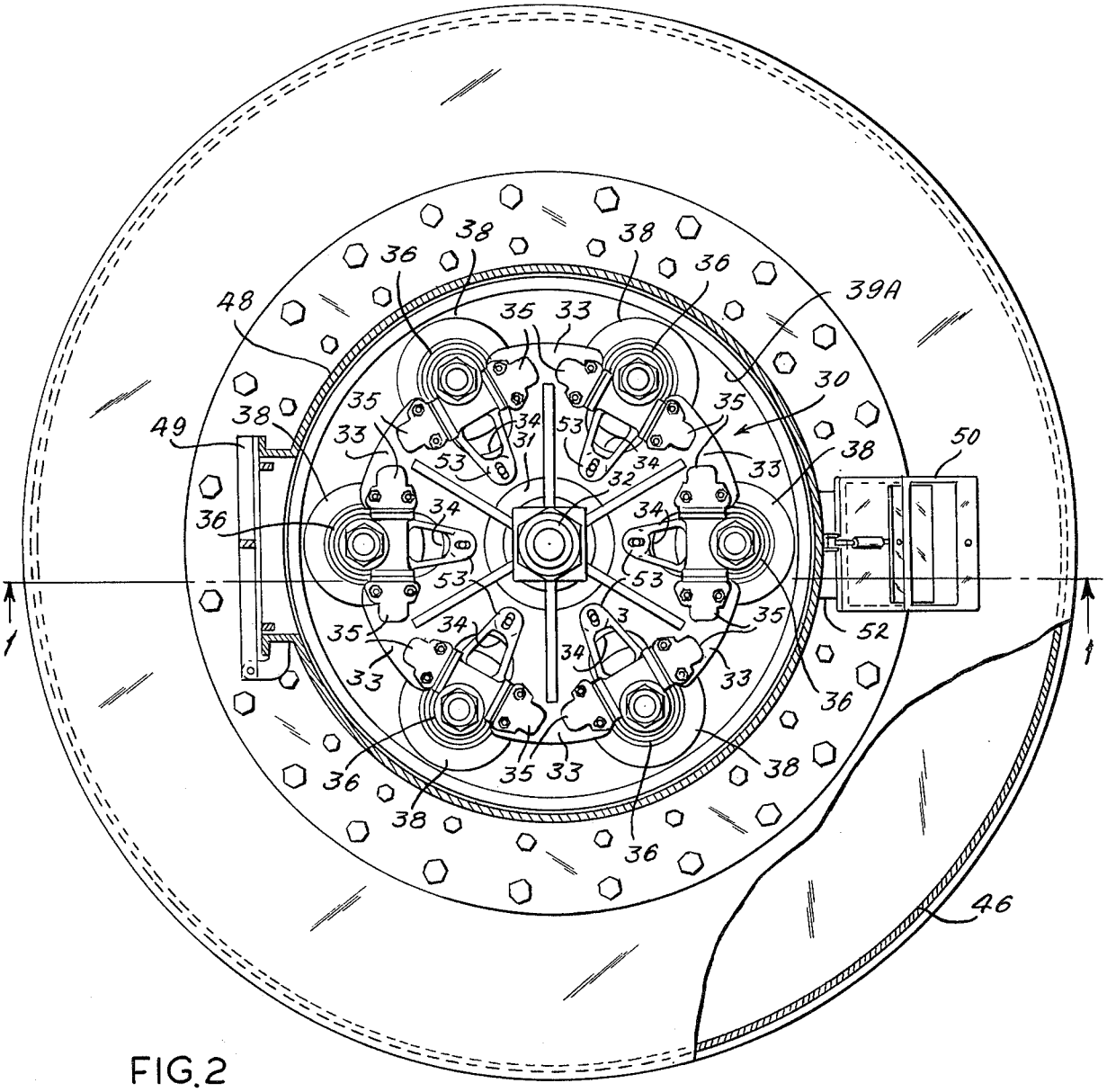
FIG. 2 is a view along line 2—2 in FIG. 1 and in fragmentary section, showing the assembly of the hanger means by which the grinding rollers are operatively suspended, and including means to maintain a predetermined gap space at the grinding face of the bull ring.

The present roller mill assembly seen in FIGS. 1 and 2 embodies a main frame structure 10 formed with a mounting flange 11 by which the frame may be supported on a suitable base (not shown). The frame 10 carries a sub-structure 12, shown only fragmentarily in FIG. 1, for the purpose of suppporting the bearings 13 for a power input shaft 14 which drives a gear 15. The gear 15 drives a speed reducing gear 16 fast on a drive shaft 17. The gears 15 and 16 are mounted in a suitable casing 18 for protection. The drive shaft 17 extends vertically upwardly through a fixed column 19 which is formed with a bell bottom wall 20 having its circumferential lip 21 mounted in the frame 10 for support and to close the bottom of a grinding chamber 22.

The shaft 17 is supported in a thrust bearing assembly 23 carried in a socket 24 depending from the under side of the bell bottom wall 20. The socket is closed by a removable closure plate 25. As the drive shaft 17 passes upwardly through the column 19 it is stabilized by a guide sleeve 26 supported on a rib projecting inwardly to support the sleeve. A seal element is held in place on the rib at the lower end of the sleeve 26. The upper end of the column 19 is provided with a lubricant reservoir 27 surrounding the portion of the shaft just below its projecting tapered end 28. A head member in the form of a spider structure 30 has a central hub 31 engaged on the tapered end 28 of shaft 17 and held by a nut 32 so that the head member 30 rotates with the shaft.

Figure 3:
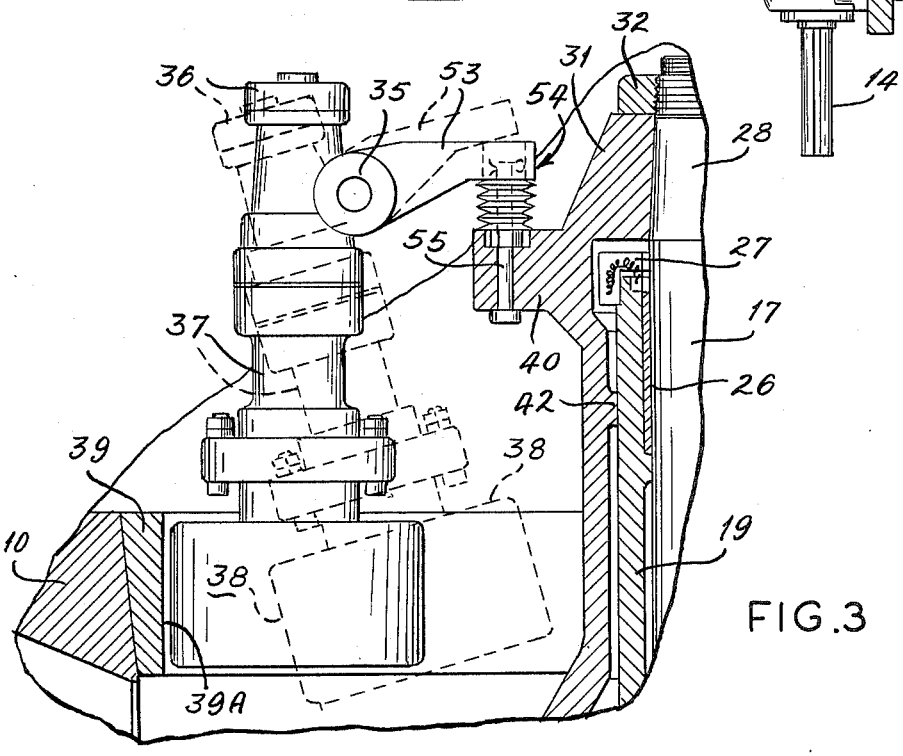
FIG. 3 is a greatly enlarged and fragmentary sectional view of a typical grinding roller, gap space maintaining means and drive for rotating the rollers relative to the grinding face of the bull ring.

Referring to FIGS. 1, 2 and 3, the head member 30 has a plurality of arms 33 (six being shown) separated by cut-outs 34. Each arm carries a pair of bearings 35 facing in opposite directions so as to align with a bearing on an adjacent arm 33 across a cut out 34. A hanger trunnion 36 is pivotally carried between each pair of facing bearings 35 for the purpose of supporting a hanger shaft 37 which depends to a level for carrying a grinding roller 38. As seen in FIG. 1 the level of the grinding rollers 38 is surrounded by a bull ring 39 which is fixed in a tapered seat in the frame 10 and presents an inward grinding face 39A to the rollers.

In FIGS. 1 and 3 it can be seen that the head member 30 is attached at its under side to the top flange 40 of a tubular shaft 41 which surrounds the column 19 and has a stabilizing shoulder 42 engaged about the column 19. The lower end of the tubular shaft 41 is flared outwardly to form arms 43 which support plow blades 44. The arms are oriented relative to the grinding rollers 38 so that a plow blade 44 preceeds a grinding roller 38 so that the material to be ground will be thrown upwardly into the path of travel of the rollers 38 at the level of the bull ring 39. Thus, the plows 44 rotate in a space below the grinding rollers 38, such space having its bottom defined by the bell bottom 20. An aperture 45 is provided in the bottom of this space for the discharge of a portion of the material being processed.

The frame 10 carries a wind box or bustle 46 which surrounds the apparatus and encloses a plurality of ports 47 which open into the plow space to direct the flow of air into the material for fluidizing it and maintaining movement thereof upwardly into the grinding level of the bull ring 39 and rollers 38. The frame 10 supports a housing 48 which encloses the head member and forms a passage for the flow of the ground material to a velocity separation chamber (not shown) where the heavy material drops down into the apparatus and is subjected to further grinding. An inspection door 49 is provided for access to the head member. The housing is provided with the feed chute 50 in which a rotary feed wheel 51 is mounted at the inlet 52 admitting material while preventing blow-by from the air supply bustle 46.

In operation, it can be seen in FIG. 3 that each hanger shaft 37 and its roller is free to pivot radially inward toward the center column 19, and the roller is forced by centrifugal action upon rotation of the shaft 17 and head member 30 radially toward the fixed bull ring 39. It is undesirable to allow the roller 38 to engage the bull ring; and prior mills had of necessity to supply sufficient material to always have a layer of such material between the rolls and the bull ring to prevent metal-to-metal contact. If contact is obtained the result is vibration and noise of an extreme intensity such that the mill will self-destruct if not shut down.

In the present embodiment, each hanger trunnion 36 is formed with a radially inwardly directed arm 53 having its inner end engaged on a position control device which, in this embodiment, consists of a plurality of Belleville springs 54 held in stacked relation by a bolt 55 in the head member. These springs act as a shock absorber to smooth out the action of the rollers when hard particles of the material are in the grinding zone. Also the springs 54 control the position of the rollers when centrifugally flung radially outwardly so that there is a constant gap between the rollers and the bull ring. The number of springs 54 may be changed to give the desired gap dimension, but at no time do they interfere with the full effect of centrifugal force on the material between the rollers and bull ring.

The roller pressure on the material at the bull ring is independent of the springs 54 and wholly proportional to the speed of rotation of shaft 17 provided the normal layer of material is thick enough to back the arm 53 of the stack of springs 54. Normally the predetermined gap is about one-eighth inch, and in operation the working space will be of the order of about three-sixteenths inch. The gap space is set so its dimension is smaller than the layer of material being ground and thus the springs do not act to off-set the grinding force but do act to arrest the rolls when material has been ground or the level of material is reduced. The resulting force varies as the square of the speed, and the springs 54 do not off-set or counteract the centrifugal force, but only assure the maintenance of a desired gap.

The advantages of the present embodiment are that the mill is guarded against destructive operation, it can operate on wet or sticky material by reason of the centrifugal plows 44 and the ability to supply hot dry air through the bustle 46, and the feed rate for the mill can be modulated from zero all the way to the maximum capacity or rating of the mill without changing the grinding characteristics or particle shape of the material being ground. It can be seen that the function of the springs 54 is to establish a minimum gap, thereby in no way interferring with the crushing force relationship which is dependent on rotational speed of the shaft 17.

What is claimed is:

1. Roller grinding mill apparatus comprising a frame enclosing a space in which material to be ground is confined, a stationary bull ring fixed in said frame in position to have an inwardly presented cylindrically shaped grinding face, a plurality of grinding rollers in said enclosing space, means operably mounting said rollers for rotation about a common axis centered to said cylindrically shaped grinding face and for pivotal movement about axes perpendicular to said common axis of rotation and in planes parallel to said common axis of rotation and in radial directions toward and away from said grinding face, said operable mounting means providing for free movement of said grinding rollers away from said grinding face and limiting the radial movement toward said grinding face to a predetermined minimum gap spacing between said rollers and said grinding face without any material to be ground between said grinding rollers and said grinding face, and consisting in levered means and resilient elements to set said predetermined minimum gap spacing between said rollers and said grinding face in which said levered means is a hanger pendently supporting each rollers for pivotal movement in said planes parallel to said common axis and a lever arm on each hanger having a free end, and the resilient elements being located adjacent each lever arm free end in position to check lever movement thereby maintaining said gap spacing, means on said frame to admit material to said enclosing space above said bull ring, said material working down by gravity between said bull ring and grinding rollers to establish a layer of material of such thickness as to space said rollers from said bull ring face a distance greater than said minimum gap spacing, drive means connected to rotate said roller mounting means to generate a centrifugal force proportional to the speed of rotation urging said grinding rollers toward said grinding face whereby said operable mounting means permits said rollers to be free to move radially limited only by said minimum gap spacing, and air supply means on said frame including an air receiving bustle and ports opening between said bustle and the enclosing space in said frame below said bull ring, said ports directing air into the material to fluidize the material being ground.

2. The apparatus set forth in claim 1 wherein each lever arm is directed radially inwardly toward said common axis and moves in response to the pivotal movement of said hangers.

3. Roller grinding mill apparatus comprising a frame enclosing a space in which material to be ground is confined, a stationary bull ring fixed in said frame in position to have an inwardly presented cylindrically shaped grinding face, a plurality of grinding rollers in said enclosing space, means operably mounting said rollers for rotation about a common axis centered to said cylindrically shaped grinding face and for pivotal movement about axes perpendicular to said common axis of rotation and in planes parallel to said common axis of rotation and in radial directions toward and away from said grinding face, said operable mounting means providing for free movement of said grinding rollers away from said grinding face and limiting the radial movement toward said grinding face to a predetermined minimum gap spacing between said rollers and said grinding face without any material to be ground between said grinding rollers and said grinding face, said operable mounting means including a head member, arms extending radially from said head member and spaced circumferentially about the common axis of rotation, pivot bearing means on each arm defining an axis of movement which is horizontal and perpendicular to said axis of rotation, hanger means attached to each pivot bearing and pendently directed, said grinding rollers being supported by said hanger means, a stop arm on each hanger means adjacent said pivot bearing and adjacent arm of said head member, said stop arms extending inwardly toward said axis of rotation, and resilient means carried by said arms on said head member in position to be engaged by said stop arms and establish said predetermined minimum gap spacing.

* * * * *